United States Patent [19]

Komiya et al.

[11] Patent Number: 4,497,568

[45] Date of Patent: Feb. 5, 1985

[54] IMAGE FORMATION APPARATUS

[75] Inventors: Yutaka Komiya, Tokyo; Yoshimasa Kimura, Kawasaki; Koichi Murakami, Tokyo, all of Japan

[73] Assignee: Canon Kabushiki Kaisha, Tokyo, Japan

[21] Appl. No.: 401,676

[22] Filed: Jul. 26, 1982

[30] Foreign Application Priority Data

Dec. 20, 1977 [JP] Japan ..... 52-154173

[51] Int. Cl.[3] ..... G03G 15/22

[52] U.S. Cl. ..... 355/14 R; 355/14 FU; 355/30

[58] Field of Search ..... 355/3 R, 14 R, 14 FU, 355/30

[56] References Cited

U.S. PATENT DOCUMENTS

| | | | |
|---|---|---|---|
| 3,976,374 | 8/1976 | Hickman | 355/14 R |
| 4,054,380 | 10/1977 | Donohue et al. | 355/3 R X |
| 4,139,300 | 2/1979 | Katayama et al. | 355/14 R |

*Primary Examiner*—Fred L. Braun

*Attorney, Agent, or Firm*—Fitzpatrick, Cella, Harper & Scinto

[57] ABSTRACT

In image formation control apparatus having a process unit for forming an image on a recording medium and mechanisms for assisting in the image formation, there is provided a first controller for controlling the timing of the process unit. A second controller is provided for rendering at least a portion of the process unit inoperative when an image formation is not being executed, and for thereafter rendering at least one of the assisting mechanisms inoperative while continuing to apply power to the first controller to enable image formations to be resumed.

22 Claims, 17 Drawing Figures

| FIG. 8A | FIG. 8B |
| --- | --- |

| FIG. 11A | FIG. 11B |
|---|---|

IMAGE FORMATION APPARATUS

This is a continuation of application Ser. No. 969,884, filed Dec. 15, 1978, now abandoned.

BACKGROUND OF THE INVENTION

1. Field of the Invention

This invention relates to image formation apparatus such as a copying machine, and more particularly to the sequence control of electric loads associated with image formation.

2. Description of the Prior Art

In the copying machines of the prior art, all the electrical loads are shut off when the main switch is opened after a completion of the copying and therefore, various preparatory processes are required to resume copying thereafter. For example, waiting time until the heater warms up to an appropriate temperature and cleaning time for the photosensitive medium are too long to smoothly resume the copying. However, leaving the main switch closed even after a completion of the copying so as to permit the copying to be resumed on the spot has led to the consumption of the power, shortened mission time of the loads, noise and other various problems.

SUMMARY OF THE INVENTION

It is an object of the present invention to provide image formation apparatus which can smoothly resume image formation after the completion of image formation.

It is another object of the present invention to provide image formation apparatus which consumes less power and produces less noise even if a main switch is left closed when no image formation is effected.

It is still another object of the present invention to provide image formation apparatus which is provided with a compensating heater or the like to warm up a photosensitive medium, developer, an exposure lamp, etc., having atmospheric characteristics such as temperature and humidity, and in which these are operatively controlled in response to a closing operation of the main switch and a image forming operation to compensate for the environment of the photosensitive medium, the developer and the exposure lamp, thereby producing images of good quality by the resumption of image formation in spite of low temperature and high humidity.

It is a further object of the present invention to provide image formation apparatus which is provided with a time mode wherein power supply to support loads such as an exposure lamp pre-heating circuit, and a heat discharge fan is held during a down-time of the apparatus after completion of image formation and a time mode wherein the power supply is cut off while the power supply to a control portion is held for the various display operations and for the checking of the presence of copy paper sheet, developer and the like, whereby the handling of the apparatus may be made highly safe and easy.

The invention will become more fully apparent from the following detailed description thereof taken in conjunction with the accompanying drawings.

DESCRIPTION OF THE PREFERRED EMBODIMENTS

Figure 1:
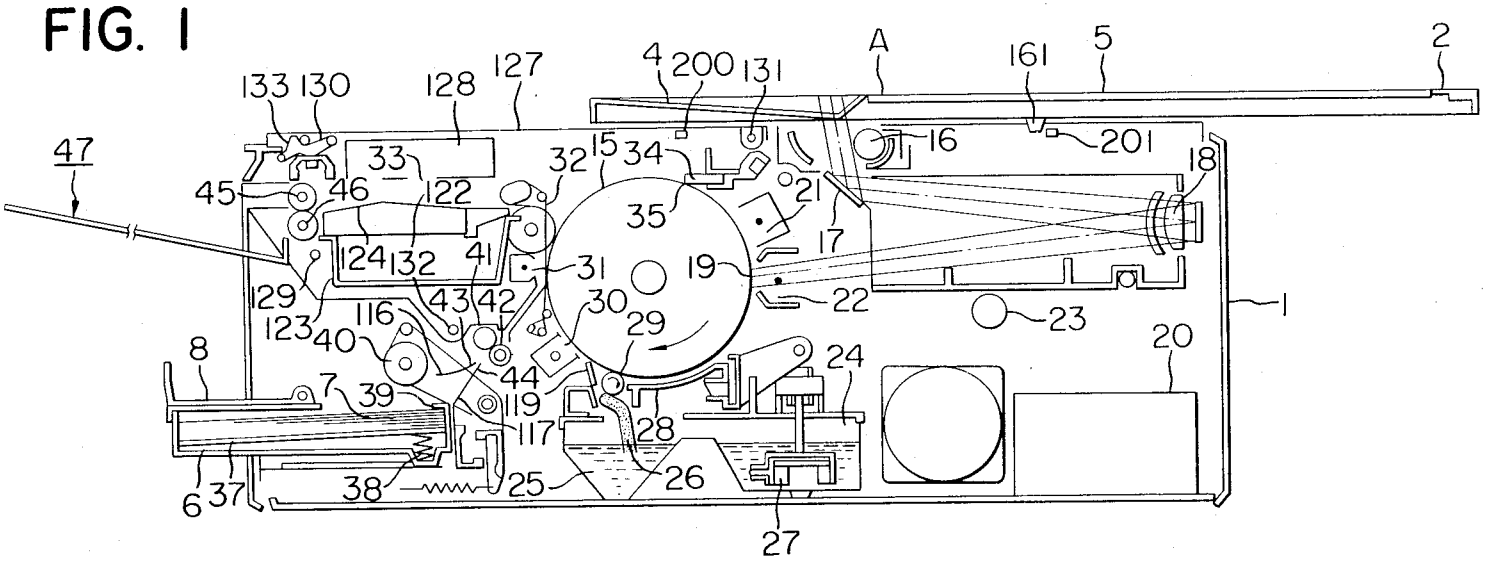
FIG. 1 is a cross-sectional view of a copying machine to which the present invention is applicable.

FIG. 1 is a cross-sectional view of a copying apparatus to which the present invention is applicable. Operation of the apparatus will first be described. When the main switch of the apparatus is closed, a digital control circuit is reset and when a short time (here, about four seconds) for the rising of the other electric system elapses, a photosensitive drum 15 having a three-layer photosensitive medium on the surface thereof is rotated. A clock pulse generating mechanism is provided in a portion of the driving system so as to put out about n clock pulses per full rotation of the photosensitive drum. The photosensitive drum 15 first makes one full rotation or substantially one full rotation corresponding to the n clock pulses. This may be regarded as a pre-stage before the copying cycle is entered and is for obtaining copies of good quality once the copying cycle has been entered and may sometimes be omitted. Here, if a copy button is depressed, the copying cycle will be entered. When the copy button is closed, the photosensitive drum 15 is rotated by n′ and only at this time, an original supporting carriage 2 having a glass plate 5 on which an original to be copied is placed starts its forward stroke and the original is illuminated by an illuminating lamp 16 so that the image thereof is focused on the drum 15 at an exposure station 19 by a mirror 17 and an in-mirror lens 18.

The photosensitive drum comprises a seamless photosensitive medium mounted on a drum to obtain the efficient use of the surface.

As the photosensitive drum 15 continues to rotate, the surface of the photosensitive medium, namely, a transparent insulating layer covering the photoconductive layer of the photosensitive medium, is charged to the positive polarity by corona current from a positive charger 21 supplied with a high positive voltage from a high voltage source 20. Subsequently, when the photosensitive drum reaches the exposure station 19, the photosensitive drum 15 is slit-exposed to the image of the object illuminated by the illuminating lamp 16. At the same time therewith, the photosensitive drum is subjected to AC charge from an AC charger 22 supplied with a high AC voltage from the high voltage source 20. By the whole surface exposure subsequently effected by a whole surface exposure lamp 23, an electrostatic latent image of high contrast is formed on the surface of the drum, and then the drum enters the next developing step. A developing unit 24 comprises a container 26 for developing liquid 25, a pump 27 for stirring the developing liquid and raising it to a developing electrode portion, a developing electrode 28, and an electrode roller 29 rotatable just in proximity to the drum to eliminate any fog which might be present on the developed image on the drum, one end of the electrode roller being grounded. The electrostatic latent image formed on the photosensitive drum 15 is developed by toner in the developing liquid 25 raised to the developing electrode 28 by the pump 27.

Subsequently, the photosensitive drum 15 is subjected to a high voltage from the high voltage source 20 at a postcharger 30 to squeeze any excess developing liquid on the drum 15 without disturbing the image thereon. Next, a sheet of transfer paper 7 fed from a paper supply station is brought into intimate contact with the photosensitive drum 15 and the image on the photosensitive drum 15 is transferred to the transfer paper 7 with the aid of the electric field provided by the high positive voltage from the high voltage source 20 at an image transfer charger 31. After the image transfer, the transfer paper 7 is separated from the surface of the photosensitive drum by a separating belt 32 and directed to a drying-fixing station 33. The photosensitive drum 15 is cleaned by the edge portion of a blade cleaner 34 urged thereagainst to wipe off any remaining developing liquid, thus becoming ready for another cycle. The developing liquid wiped off by the blade cleaner 34 is directed into the developing unit 24 along grooves formed at the opposite ends of the photosensitive drum so as to be reused for the development.

A supply of transfer paper 7 is contained in a cassette 6 which is removably mounted in the paper supply station located leftwardly downwardly of the apparatus as viewed in FIG. 1. Various cassettes may be prepared in accordance with the sizes of transfer paper. When the original supporting carriage reaches a predetermined position, detector means provided on the apparatus body is operated to generate a signal by an actuating piece 161 fixed to the original supporting carriage, whereupon a normally rotating paper feed roller 40 is lowered into contact with the uppermost sheet of transfer paper in the cassette 6 and cooperates with a separating pawl 39 to separate and feed the uppermost paper sheet from the cassette 6. However, register rollers 41 and 42 closely adjacent to the paper feed roller 40 are stopped upon lowering of the paper feed roller 40, so that the transfer paper 7 fed from the cassette 6 has its leading end edge bearing against the nip between the register rollers 41 and 42, thus forming a slack between guides 43 and 44. When the paper feed roller is about to move upwardly, the register rollers 41 and 42 are again rotated at a timing with the leading end of the image on the photosensitive drum and the transfer paper 7 is transported at a velocity equal to the peripheral velocity of the photosensitive drum 15.

Figure 2:
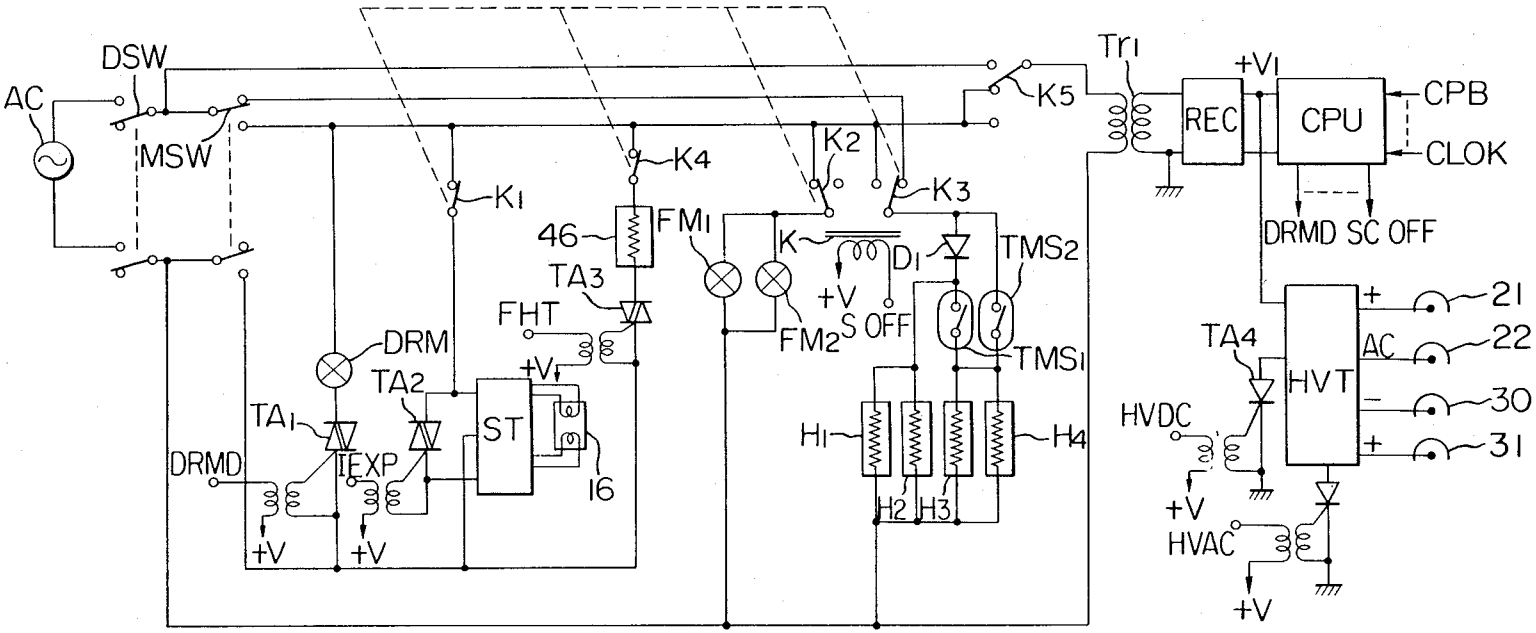
FIG. 2 diagrammatically shows an example of the control circuit for the copying machine shown in FIG. 1.
Figure 3:
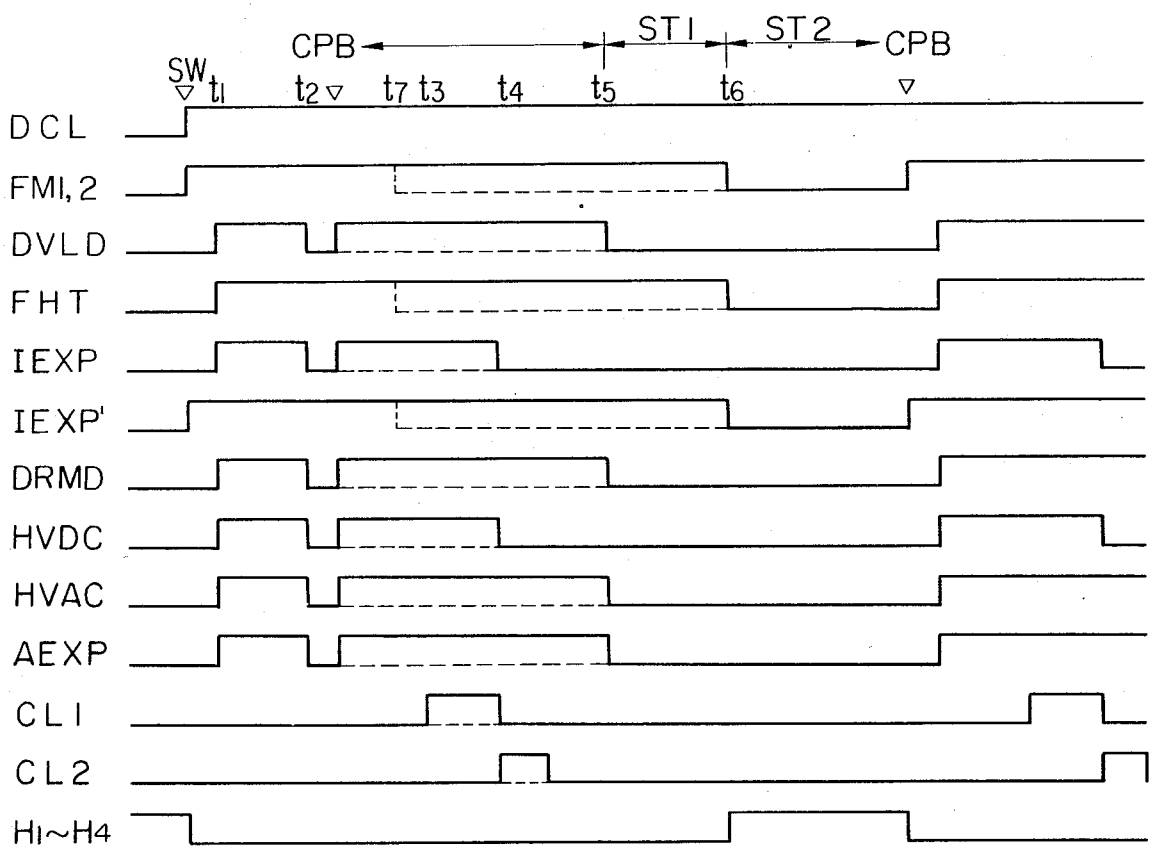
FIG. 3 is an operation time chart for the machine of FIG. 1.

FIG. 2 is a diagram of the circuit for controlling the operation of the various image forming process units of FIG. 1, and FIG. 3 is a signal time chart therefor.

Figure 5:
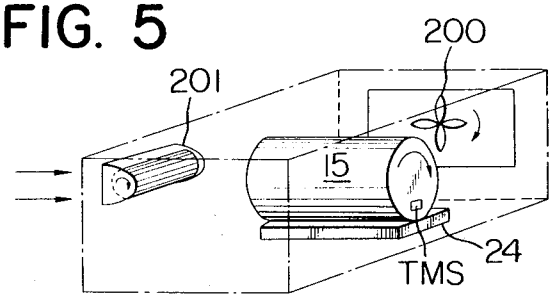
FIG. 5 is a perspective view of the machine shown in FIG. 1.

FIG. 2 includes an AC power source AC, a door switch DSW adapted to be opened (the shown position) upon opening of a side plate of the copying machine of FIG. 1, a main switch MSW (shown in its open position) located in the operating portion of the copying machine, a motor DRM for rotating the drum 15, a starter ST for turning on the lamp 16, a fan motor FM1 (200 in FIG. 5) for cooling the optical system within the machine, a blower motor FM2 (201 in FIG. 5) for sucking the extraneous air into a fixing heater, a rectifier REC for rectifying the AC voltage dropped by a transformer Tr1 into a voltage +V1, a central processing circuit CPU for generating a control signal for controlling the copying machine (i.e., for controlling the state of activation of a number of energizable means, listed below), a converter HVT including a DC-AC converter and a transformer for boosting the output thereof, a triac TA1 for energizing and deenergizing the motor DRM, a triac TA2 for turning on and off the lamp 16, a triac TA3 for energizing and deenergizing a fixing heater 46, a triac TA4 for energizing and deenergizing the chargers 21, 30 and 31, a triac TA5 for energizing and deenergizing the AC charger 22, a heater H1 for pre-heating the fixing heater, a planar heater H2 stretched along the inner periphery of the drum to warm up the photosensitive medium, a pre-heater H3 for warming up the illuminating fluorescent lamp 16 to quicken the response thereof, a heater H4 disposed at the bottom of the container of the developing unit 24 to warm up the developing liquid 25, thermoswitches TMS1 and TMS2 for deenergizing the heaters H3 and H4 at temperatures above 25° C. and 10° C., respectively, a diode D1 for supplying a half-wave power to the heaters H1, H2 and H3, and a relay K for changing over contacts k1–k4.

Reference is now had to FIG. 3 to describe the operation.

When the side plate is closed to close the main switch MSW, the fan motors FM1 and FM2 operate and the preheat power supply to the starter ST for the exposure lamp 16 is effected through the contact k1. A signal for resetting the control circuit is generated by the CPU for a predetermined time after the DC power source has been connected. At time t1, the CPU puts out a motor signal DVLD to rotate the stirrer 27 and stir the developing liquid. Also, a pulse signal FHT for turning on the triac TA3 is put out to heat the heater 46, and a pulse ignal IEXP for turning on the triac TA2 is developed to turn on the lamp 16, and a pulse signal DRMD for turning on the triac TA1 is produced to rotate the drum 15, and pulse signals HVDC and HVAC for turning on the triacs TA4 and TA5 are produced to cause starting of corona discharge from the chargers 21, 22, 30 and 31, and a pulse signal AEXP is developed to turn on the whole surface exposure lamp 23.

The above-described outputs are held until time $t_2$. The time from $t_1$ to $t_2$ is the so-called waiting time during which the copy start cannot take place. The drum 19 has its surface cleaned after several full rotations thereof.

After time $t_2$, a first standby mode ST1 is entered to stop the power supply to the drum motor, the lamp 16 and the various chargers. When the copy button is depressed (signal CPB) during this mode, the previously deenergized load is again energized to effect the pretreatment before the electrostatic image formation process and at a point of time $t_3$, an advance signal CL1 is put out to start the forward stroke of the original supporting carriage 1. By the time $t_3$, the drum has made about one full rotation and the surface thereof is cleaned.

When the exposure scanning (foward stroke) is terminated at time $t_4$, the signals CL1, IEXP and HVDC are turned off and the advance clutch, lamp 16 and charger 21 are deenergized. Signal CL2 is now turned on to change over the original supporting carriage to its backward stroke and the carriage comes back to its initial stop position and stops there.

Until time $t_5$ is reached, signals DVLD, DRMD, HVAC and AEXP continue to be produced to complete the image transfer process. In the meantime, the drum continues to make several full rotations in a process-executing condition and the remaining toner on the drum surface is removed and the remaining charge is discharged.

From time $t_5$ to time $t_6$, the mode is the same as the first standby mode ST1 and the support means or heat transfer means, e.g., fans, heaters and the lamp starter circuit which assist in image formation are operating. When the copy button is again depressed during this time, the copy process is started with the above-described routine.

However, when the time $t_6$ has been reached, the support loads such as the fans are deenergized. That is, at this point of time, signal SOFF is developed from the CPU to energize the relay K and change over the contacts k1–k4 thereof. Thereby, the starter ST, the heater 46 and the motors FM1 and FM2 are deenergized.

By the contact k3, the power supply to the compensating heaters H1 to H4 are set.

The heaters H1 and H2 are heated by a half-wave of 12.5 W through a diode D1 irrespective of the ambient temperature. The heaters H3 and H4 are temperature-controlled by the thermoswitches TMS1 and TMS2.

That is, during the second stand-by mode ST2, almost all of the AC loads other than the compensating unit are deenergized and thus, the noise by the fans and the power consumption by the pre-heater or the like is eliminated.

The thermoswitches TMS1 and TMS2 are provided adjacent to a crosssection of the drum.

In this mode, the DC voltage source is maintained in its power supplying condition and so, the process can be resumed simply by depressing the copy button.

Also, in this mode, even if the main switch is opened, the signal SOFF is turned off so that the relay K releases to its initial position with the contacts thereof again brought to their shown normal positions and compensating operations of the heaters H1–H4 continue.

When the copy button is again depressed in this mode, the signal SOFF is turned off to deenergize the relay, thereby deenergizing the compensating heaters H1–H4 and operating the main motor, etc. After the incipient time $t_1$, exposure of the original is started in the same manner as the above-described CPB step.

When the copy button is not depressed even after time $t_2$ elapses after the closing of the main switch, the motors FM1 and FM2 and signals DVLD, FHT and IEXP' are automatically turned off to enter the same mode as the second stand-by mode ST2. By this, the reduction in life of the preheater and the waste of power is prevented. The chart in this case is represented by dotted lines.

The time $t_1-t_2$ is set in accordance with the time during which the main switch is opened, and the time period from turn-on of CPB till the advance start time $t_3$ is also set in accordance with the time of the second stand-by ST2, and both of them are determined by knowing the down-time from the concentration of the developing liquid (the degree of settling of the toner).

Figure 4:
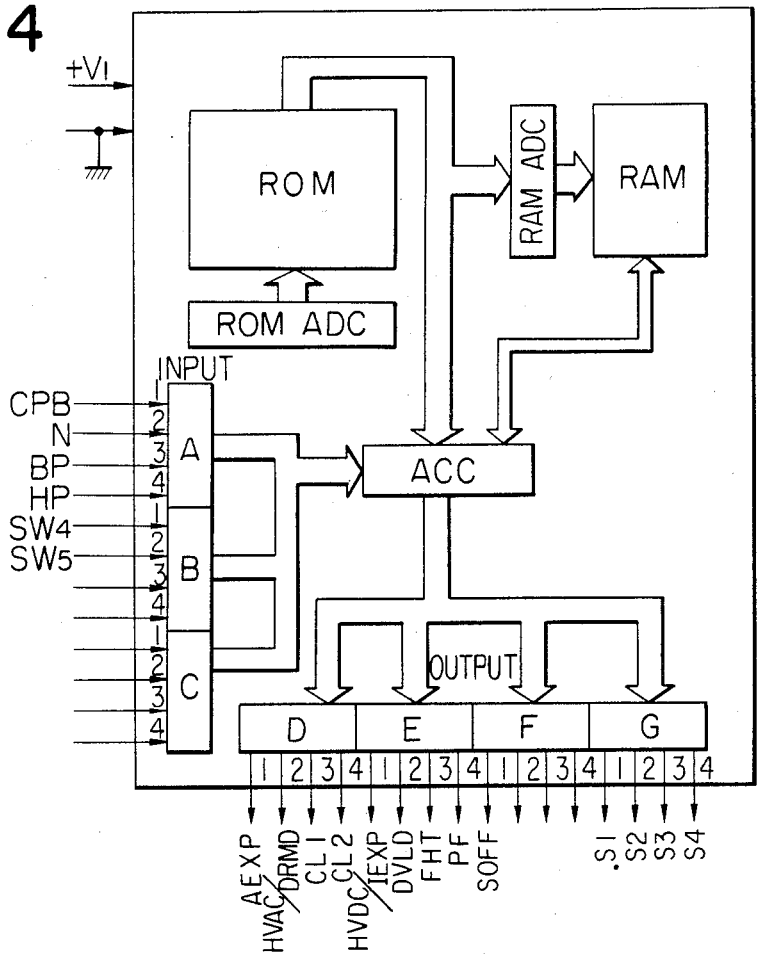
FIG. 4 shows an example of a portion of the FIG. 2 circuit.
Figure 6:
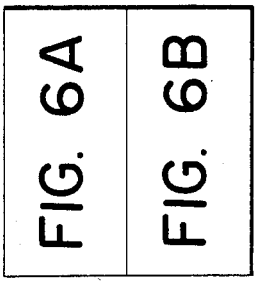
FIG. 6 indicates the interrelation of FIGS. 6A and 6B, which constitute a flow chart useful for understanding the operations of the circuit shown in FIG. 2.
Figure 6A:
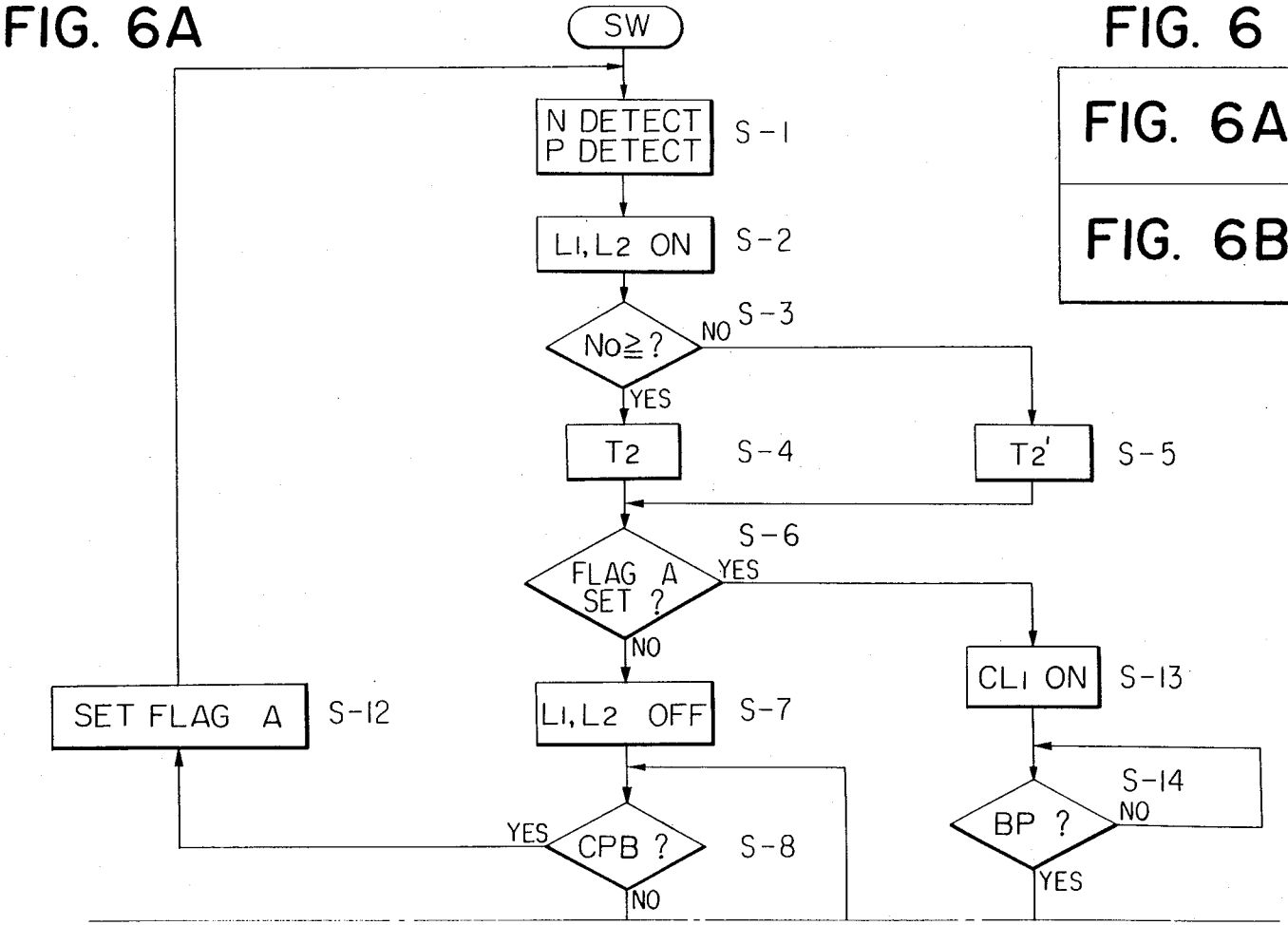
Figure 6B:
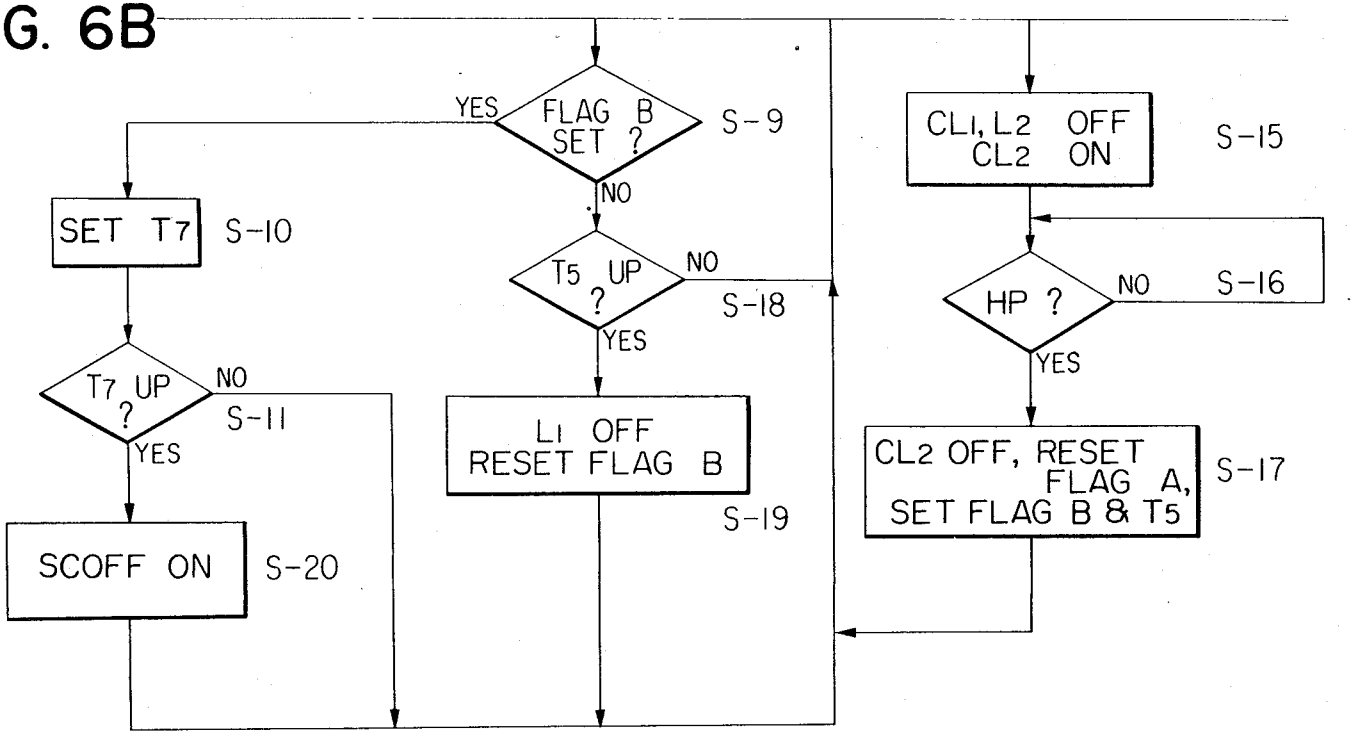

FIG. 4 is a diagram of the CPU circuit of FIG. 3, and FIG. 6 is a flow chart in which the process sequence of FIG. 3 is executed and it is pre-stored in the program memory ROM of the CPU of FIG. 4 in the form of binary coded signals. The circuitry of FIG. 4 includes a data memory RAM for storing therein the input signal data such as the data of the program memory, the number of copies, etc., an input port INPUT for gating in the input signal, an output port OUTPUT for latching the output signal, and an accumulator ACC for temporally storing the data from the input port and the data to the output port. The CPU further has an ALU for operating and logically discriminating the data from a decoder for decoding the codes of the ROM, and the data from the ROM, RAM and input and output ports. A signal CPB which becomes "1" upon a depression of the copy button, developing liquid concentration signal (which is "1" for below a prescribed concentration), original supporting carriage reverting position signal BP, ON-signal of a switch 201 by a cam 161, stop position signal HP and ON-signal of a switch 200 by the cam 161 are applied as input to the terminals one to four of the A port of the input port INPUT, and signals AEXP, HVAC, DRMD, CL1, CL2 are developed from the terminals one to four of the D port of the output port OUTPUT.

Here, the input data is introduced into the ACC through a specific step in accordance with the execution of the program of ROM and logically discriminated therein to advance to another step, thereby controlling the copy operating load.

FIG. 6 is a flow chart of the program steps stored in the ROM. When the main switch is closed, power is supplied to a developing liquid concentration detecting circuit (not shown) which senses the value N of the concentration from the port A of the CPU. Whether the value of concentration is below N or not is discriminated at a step S-3. If the value is below N, the down-time of the machine is regarded as long and the pre-processes such as the stirring of the developing liquid and the cleaning of the dried drum surface are effected. Steps S-2, S-4 and S-5 correspond to this and L1 is the load by DRMD, HVAC, AEXP and DVLD and L2 is the load by IEXP and HVDC. When the detected concentration is below No, a timer of time $T_2$ is operated and in the meantime, the loads L1 and L2 are turned on to wet the drum surface to clean the same and uniformize the photosensitive characteristic of the photosensitive medium. When the time is up, the step advances to a step S-6. If, then, the detected concentration is above No, a pre-process is effected for a time $T_2'$ which is one-half of the time $T_2$ (S-5).

In the step S-6, whether the A address of the memory RAM is "1" or not is discriminated and the next step is selected. Since flag A is not set unless the copy button is depressed, the step S-7 is entered and D port one and E port 2 of the CPU are turned off to turn off the loads L1 and L2. Next, the step S-8 is entered and whether the copy button is depressed is read out. While the copy button is not yet depressed, the step S-9 is entered and whether the flag B is "1" is discriminated. Since the flag B is set when the copying is terminated (S-17), it is in a reset condition here. Consequently, the step S-10 is entered and the timer $T_7$ is set. Each timer is formed within the CPU and well-known. In the step S-11, whether the time of the timer $T_7$ is up is discriminated and while the time is not up, the step again returns to the step S-8 and advances to the step during which the copy button is read. If the CPB is turned on in the meantime as shown in FIG. 3, the step S-12 is entered to set the flag A and then the step S-1 is entered. The pre-process is effected as already noted (for the short time of the timer $T_2'$), and the step S-6 is entered. Since the flag A has been set in the step S-12, the step advances to the step S-13 and energizes the drive source clutch CL1 to start exposure of the original.

Next, when whether the original supporting carriage has completed exposure and come to the reverting position is discriminated in the step S-14, the load L2 is turned off by the step S-15 and the backward process takes place. When the carriage comes back to the stop position, the step S-17 is entered to set the flag B, reset the flag A, deenergize the clutch CL2 and set the timer $T_5$. $T_5$ is the cleaning time period during the post-rotation (one full rotation) after the image transfer. When the copy button is again depressed in the meantime, the copying is again initiated through the steps S-8 and S-1. When the copy button is not depressed, the step S-9 is entered and whether the flag B is set is discriminated, and then the step S-18 is entered to discriminate whether the timer $T_5$ is timed up. When the timer $T_5$ counts up, the load L1 is turned off to reset the flag B so that the first stand-by condition St1 is entered.

Thereafter, the timer $T_7$ is timed up through the steps S-8, S-9, S-10 and S-11, whereupon the auto shut-off step S-20 is entered. From the output port F the signal SCOFF is developed to deenergize the fan motors, heaters, etc. and the waiting condition (the second stand-by ST2) is entered. Thereafter, when the copy button is depressed, the output of SCOFF is stopped (S-8) and the pre-rotation corresponding to the stand-by time is executed to initiate the process as already described (S-3 to S-6). When the main switch MSW is opened in the stand-by ST2, the CPU is disconnected from the power source so that SCOFF is stopped.

In the above-described flow, the absence of a paper sheet in the cassette and the absence of the developing liquid is discriminated in the step S-1 and is displayed while, at the same time, the advance of the ensuing steps is blocked to enable only the display routine to take place.

The shut-off signal SCOFF may be produced not only when the time period of the first stand-by is up but also when the transfer paper jums during its conveyance. It is made possible by providing a well-known jam detecting step and a step in which the signal SCOFF is produced upon a detection of jam, in FIG. 6. When the jam occurs, the heaters H1 to H4 may be turned off to enhance the safety during the treatment of the jam.

It is also possible to hold the power source for the DC control circuit independently of the door switch DSW, or in other words, independently of the main switch MSW in FIG. 2, whereby various displays may conveniently be continued when the door is opened to remove the paper jam.

Figure 7:
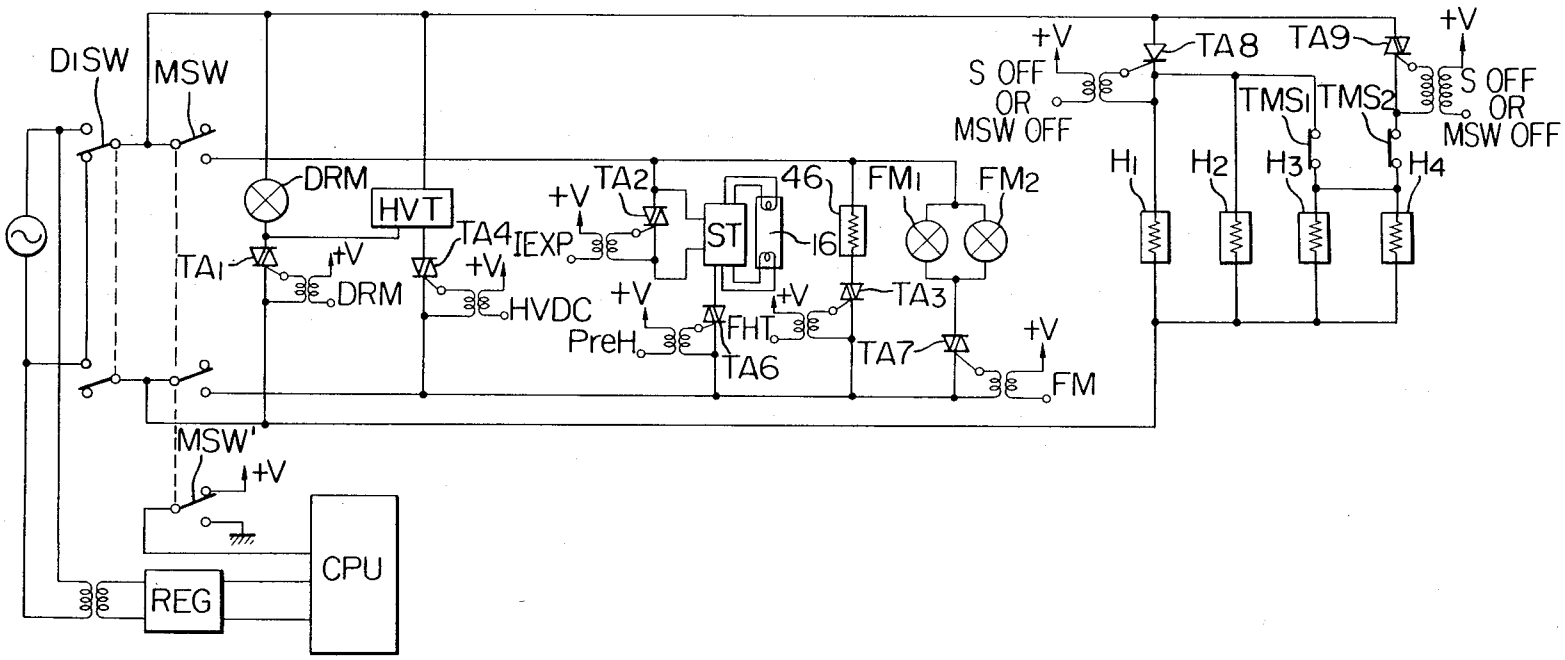
FIG. 7 diagrammatically shows another example of the control circuit.

It can be carried out, for example, by a circuit shown in FIG. 7. In FIG. 7, TA6, TA7, TA8 and TA9 are triacs and thyristors functionally corresponding to relay contacts k1, k2, k3 and D1, k3. MSW' is a switch operatively associated with the main switch MSW to detect the state of the MSW and applies it as input to the CPU. That is, it detects the high level during the OFF condition of the MSW and turns on the thyristor TA8 and the triac TA9. Thereby, as in FIG. 2, the compensating heaters H1–H4 operate when the shut-off signal SCOFF is set or the main switch MSW is closed. Signals PH and FM are produced from the CPU when the MSW is in its ON position and the signal SCOFF is OFF, to turn on the TA6 and TA7. Consequently, the preheaters and fans effect the timing operation as shown in FIG. 3. Also, when a paper jam occurs, it is possible to open the sid plate to treat the jam and to smoothly initiate the copying when the side plate is closed to resume the process, since the CPU power source is held. Further, even if the MSW is opened during the post-rotation between $t_4$ and $t_5$ of FIG. 3, signals DRMD and HVDC are produced to stop the rotation of the drum at $t_5$. Thereby, the drum surface can be cleaned completely.

Figure 9:
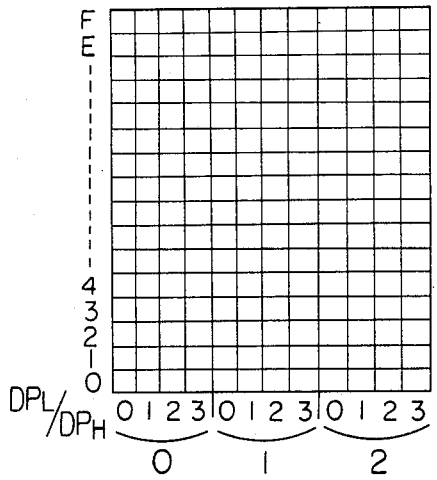
FIG. 9 shows a memory area.
Figures 8, 8A:
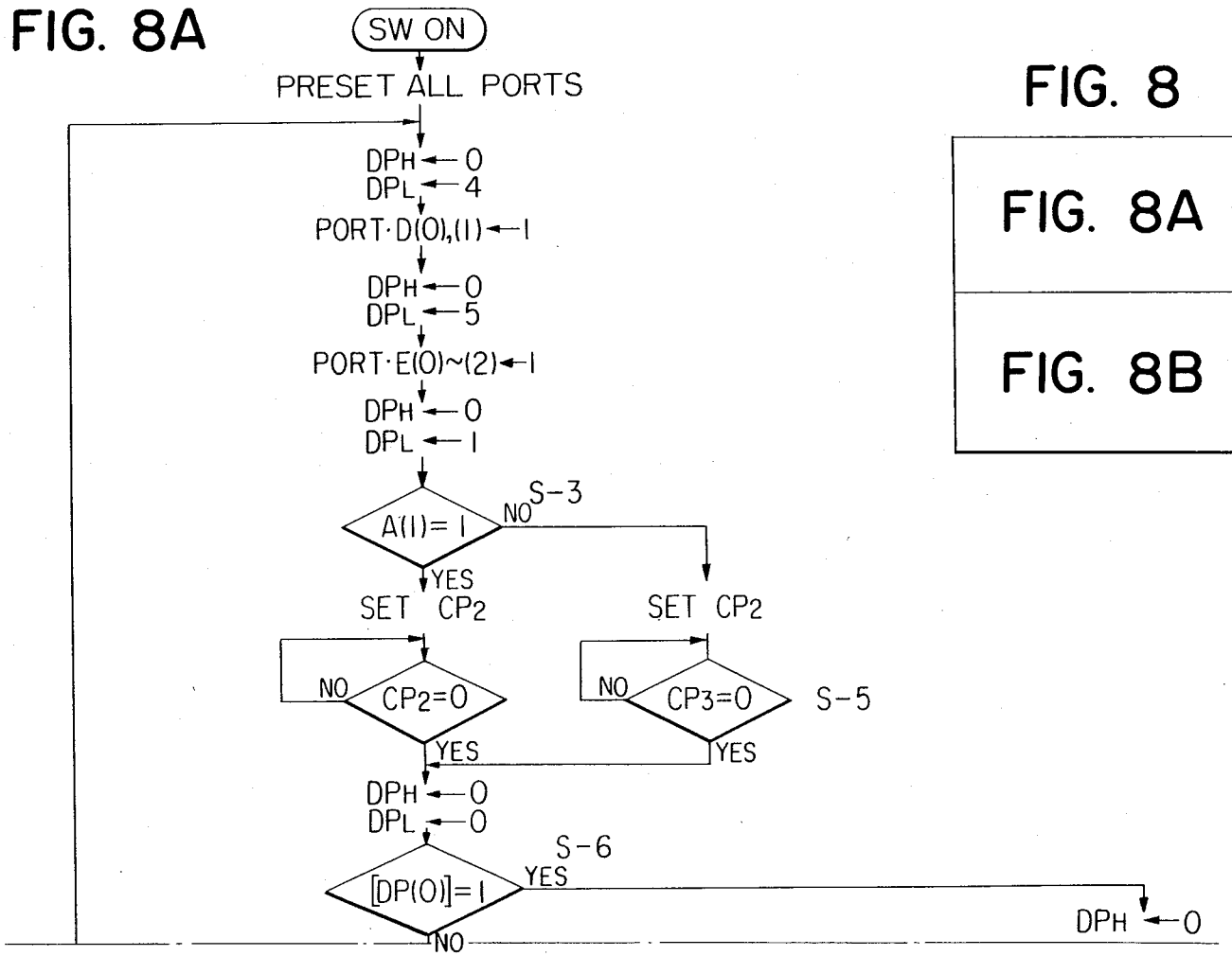
FIG. 8 indicates the interrelation of FIGS. 8A and 8B, which constitute a flow chart useful for understanding the operations of the circuit shown in FIG. 6.
Figure 8B:
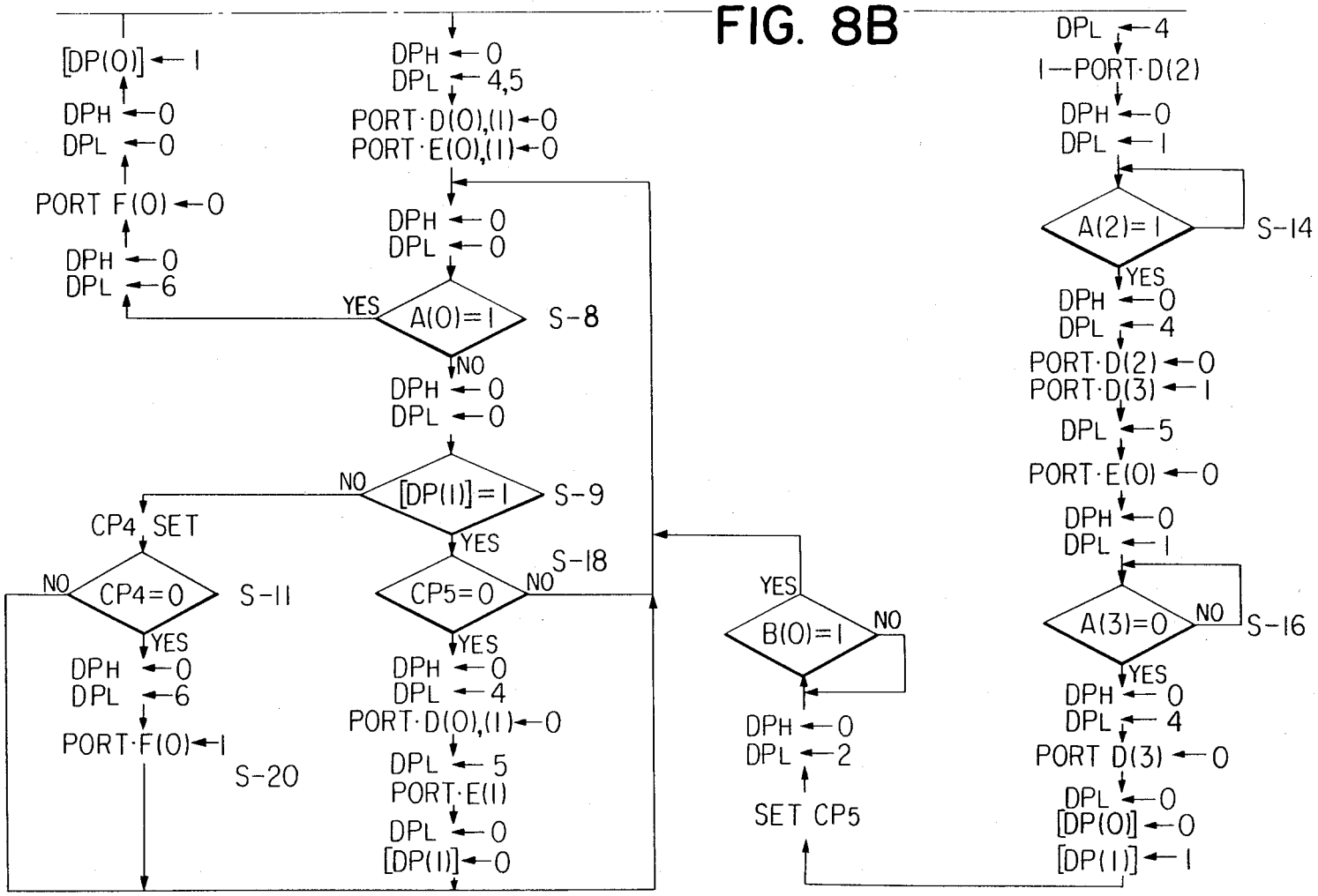

FIG. 8 shows an example of the flow chart represented by the word mode when the flow of FIG. 6 is executed by the use of a microcomputer NPD546 (Nippon Electric Co., Ltd.). Briefly describing, $DP_H$ and $DP_L$ denote registers referred to as data pointers which lie in the CPU for designating the area of the memory RAM (FIG. 4) and designating the input and output ports of the CPU. The address of the RAM area is shown in FIG. 9. CP2–CP5 set shows that the timer times $T_2$, $T_2'$, $T_5$ and $T_7$ for executing the timer operations in the CPU are set to the RAM. The machine words with each step of this flow as the unit are stored in the ROM and are successively read out upon closing of the main switch for the CPU to execute the operation shown in each step.

After the circuit is reset after closing of the MSW and the power is supplied to the CPU, the numbers 0, 4 are set to the data pointers to designate the output port D, and the number 1 is set to the 0, 1 bit thereof, and the 0, 5 are set to the data pointers to designate the output port E and the number 1 is set to the 0–2 bit thereof, thus turning on the loads L1 and L2. The numbers 0, 1 are set to the data pointers to designate the input port A and discriminate whether the 1 bit thereof is "1" or not, thus detecting whether the concentration of the developing liquid is below a predetermined level or not. When the 1 bit is "1", a long time timer CP2 is set to apply "−1" to a specific address of the RAM for each clock pulse frequency-divided for the computer run. When the count is up to terminate the timer, the numbers 0, 0 are set to the data pointers to designate the area of the flag A of the RAM and discriminate whether the 0 bit thereof is "1" or not, thus detecting the state of the flag A. A timer CP3 which executes the time count when the concentrations of the developing liquid is above the predetermined level corresponds to a little over one full rotation of the drum.

The following is executed in the above-described sequence. Since the flag A is not "1", the loads L1 and L2 are turned off to enter the stand-by condition and discriminate the depression of the copy button. When the copy button is in ON position, the address 0, 0 of the RAM is designated and "1", namely, the flag A is set to the 0 bit of the area thereof, and the routine of the drum pre-rotation (for the time determined by CP3) is again entered to set the 2 bit of the port D and deenergize the CL1, thereby starting the exposure process. When the depression of the copy button is not detected in the step S-8 and the time of the timer $T_7$ for measuring the first stand-by time is up, the port F is designated to set "1" to the D bit thereof to thereby render the machine into unto shut condition. After the step S-17 whereat the process is terminated, the input port B is designated to discriminate whether the 0 bit thereof is "1" or not, and sense the detecting operation of a paper detector 129 provided at the exit of the transfer paper path. When the detecting operation is detected, namely, when signal SW4 is "1", the machine prepares for the resumption of the copying. When the detecting operation is not detected, the output port F is designated to develop the shut-off signal SCOFF. In the step S-20, an unshown flag C is set and reset in the step S-3, and after the discrimination of the copy button in the step S-8, it is discriminated to discretly use the pre-rotation timers $T_2$ and $T'_2$, thus enabling the pre-rotation for $T_2'$ to take place in the reset condition of the flag C.

Figure 10:
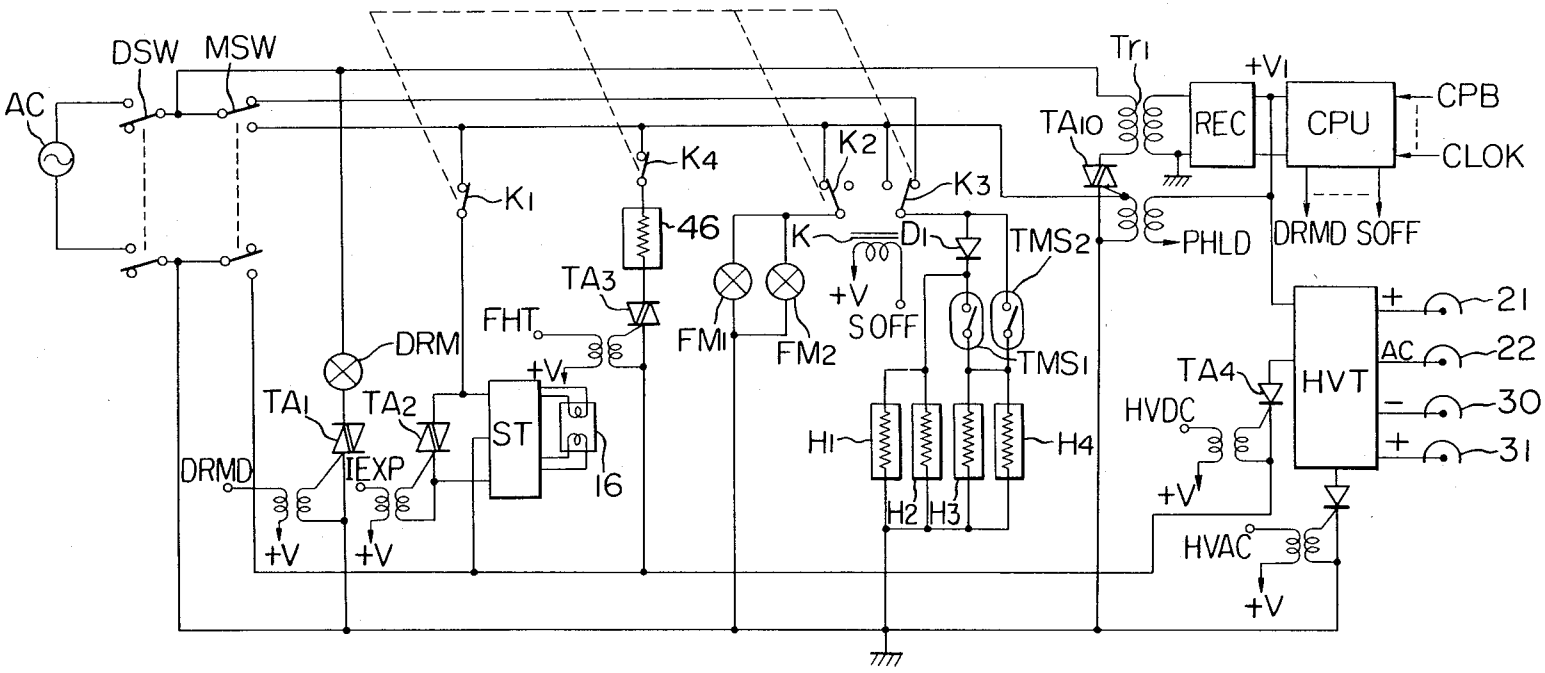
FIG. 10 diagrammatically shows still another example of the control circuit.

FIG. 10 shows another example of the circuit in which the power source for the CPU is held under designated conditions. This corresponds to FIG. 2 in which the contact k5 is changed over to hold the power source. In FIG. 10, TA10 is a triac adapted to be turned on by the ON signal of the MSW or the hold signal PHLD. That is, the CPU starts operating upon closing of the MSW, but since the signal PHLD is produced between $t_4$ and $t_5$ of FIG. 3, the rotation of the drum and AC discharging continue till the time $t_5$ even if the MSW is opened in the meantime. Thus, irregularity of the cleaning is prevented from occurring. Also, when a jam is detected, PHLD may be developed to hold the power source as noted above. Further, when a jam occurs, it is possible to hold the CPU power source in spite of the opening of the DSW and to close an unshown jam reset switch and switches DSW and MSW to enable copying.

Figure 11A:
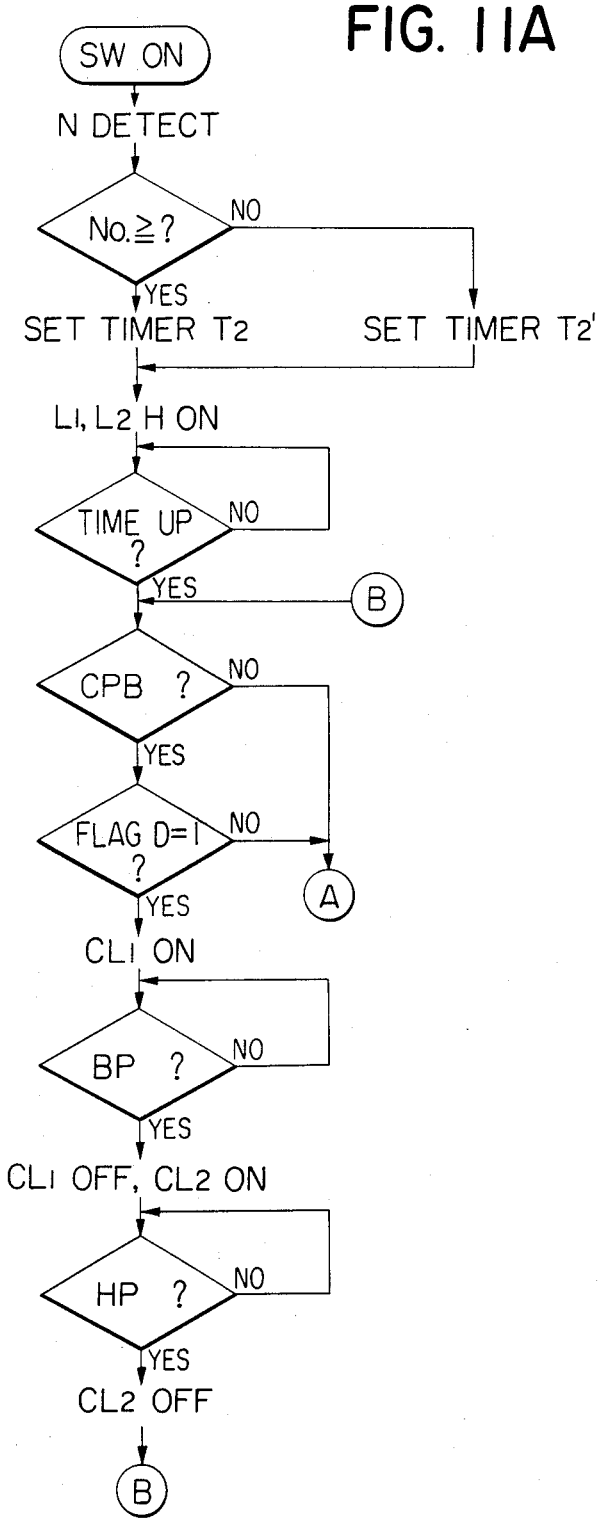
FIG. 11 indicates the interrelation between FIGS. 11A and 11B, which constitute a control flow chart.
Figures 11, 11B:
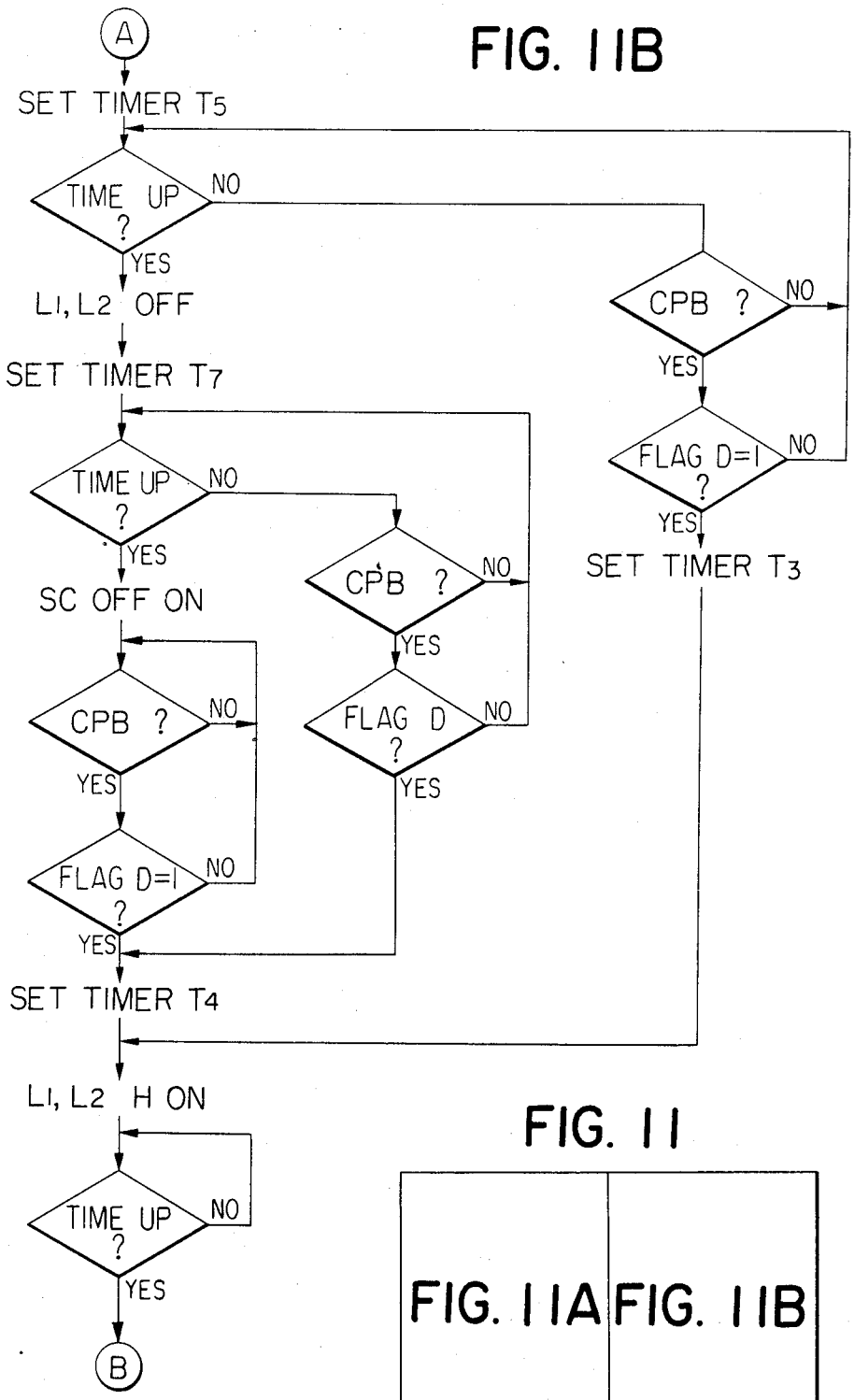

FIG. 11 shows another example of the control program sequence. Briefly describing, after the closing of the main switch, the input of the port A is discriminated in the manner as described in connection with FIG. 8, to set the timer $T_2$ or $T_2'$. Then, the ports D and E are designated to turn on the loads L1, L2 and H. After the time of the timer $T_2$ is up, whether the copy button is depressed or not and whether the flag D is "1" or not are discriminated. The flag D is adapted to become "0" in the absence of the cassette in the machine body, the absence of a paper sheet in the cassette or the absence of the developing liquid in the container, and represents the possibility of the copying. When these conditions are satisfied and when the copy button is depressed, the clutch CL1 is energized to initiate the copying. When the copy button is in its OFF position, the timer $T_5$ is set and the loads L1 and L2 are turned off when the timer $T_5$ is timed up, and then the timer $T_7$ is set to enter the first stand-by. When the timer $T_7$ is counted up, the signal SCOFF is produced. When the copy button is in its ON position during the first and second stand-bys, the timer $T_4$ is set, but if the copy button is in its ON position during the time of the timer $T_5$, namely, during the post-rotation, the timer $T_3$ which is shorter in time than the timer $T_4$ is set. If the timer $T_3$ is set to the time required for the drum surface facing the image transfer charger 31 to pass through the exposure station 19 and the timer $T_4$ is set to the time required for the drum surface facing the blade 34 to pass through the exposure station 19 twice, it is effective for the subsequent image formation of good quality. During $T_3$ and $T_4$, and discharging and cleaning of the drum surface takes place. If the copy button is released during this time, the copying will not start. The subsequent copying operation is effected by the holding of the copy button. When the original supporting carriage returns to its stop position after a completion of the copying, the copy button is again checked to repeat another copy cycle. When a number of copies preset in a dial or the like has been produced, the copy button is released by detection of the last cycle reverting position BP, so that thereafter the cleaning cycle of the timer $T_5$ is entered and the machine waits at the stand-bys 1 and 2. In FIGS. 8 and 10, the timers $T_2$, $T_2'$, $T_3$–$T_5$ may be of the clock pulse number generated in accordance with the rotation of the drum and the discrimination of the termination of each timer may also be accomplished by the pulse count routine, namely, the routine wherein whether the pulse number becomes "0" by subtracting "1" therefrom is discriminated at each input of the pulse.

What we claim is:

1. An image forming control apparatus, comprising:
a rotatable member;
a plurality of energizable means for forming an image on said rotatable member and for transferring the image to a transfer material, said plurality of energizable means including imaging means and heat transfer means for affecting the temperature of a portion of the apparatus;
switch means for initiating an image forming operation by transmitting an image forming signal;
control means for controlling the energization state of said energizable means to provide a plurality of energizational modes, including;
an image forming mode wherein said member is rotated and at least some of said energizable means are energized to effect the formation of images;
a post-rotation mode wherein said member is rotated to effect cleaning thereof for a predetermined time interval following the termination of said image forming mode;
a first standby mode wherein said member is stationary but at least some of said energizing means including said heat transfer means are maintained in an energized state, whereby the apparatus is maintained ready to proceed to the image forming mode in response to a signal from said switch means; and
a second standby mode which commences upon the termination of the first standby mode if, during the first standby mode, no signal is transmitted by said switch means, wherein the heat transfer means is switched from an energized state to a de-energized state but wherein at least one other energizable means remains activated;
wherein said control means controls the time interval between the actuation of said switch means and activation of said imaging means in accordance with the time of actuation of said switch means, when said switch means is actuated.

2. Image forming control apparatus according to claim 1, wherein said control means sets said time interval in accordance with the length of the non-operation time of said switch means after image formation.

3. Image forming control apparatus according to claim 1, wherein said control means sets said time interval in accordance with whether said switch means is actuated during or after said first standby mode.

4. Image forming control apparatus according to claim 2 or 3, wherein said control means controls the amount of rotation of said rotatable member prior to the start of an image forming operation.

5. Image forming control apparatus according to claim 1, wherein said heat transfer means includes at least one means selected from the group consisting of corona discharger means for providing corona discharging of said rotatable member, exposure means for exposing an original, and developing means for forming a visual image on said rotatable member.

6. Image forming control apparatus according to claim 1, wherein said heat transfer means includes at least one member selected from the group consisting of means for heating an exposure means for scanning an original, means for fixing the transferred image, and fan means for preventing temperature rise in the apparatus.

7. Image forming control apparatus according to claim 1, further comprising means for compensating the image formation, said compensating means operating at least after said heat transfer means has been de-energized during said second standby mode.

8. Image forming control apparatus according to claim 7, wherein said compensating means comprises at least one means selected from the group consisting of means for warming up said rotatable member, means for pre-heating a fuser for fusing the transferred image, means for pre-heating an exposure means for exposing an original, and means for pre-heating a developer for developing a latent image.

9. Image forming control apparatus according to claim 1, further comprising at least one means selected from the group consisting of means for cleaning said rotatable member during rotation thereof, means for providing a uniform exposure and means for providing a uniform discharging.

10. Image forming control apparatus according to claim 1, wherein the image formed on said rotatable member is formed with a liquid developer.

11. An image forming apparatus including:

a rotatable member;

a reciprocal member for scanning a document;

a plurality of energizable means including heat transfer means for affecting the temperature of a part of the apparatus; and control means for controlling the energization state of said energizable means to provide a plurality of energizable modes, including:

an image forming mode wherein said rotatable member and said reciprocal member are moved and at least some of said energizable means are activated to effect the formation of images;

a successive rotation mode wherein said rotatable member is rotated to effect cleaning thereof following the termination of the formation of the images;

a first standby mode wherein said reciprocal member is stationary and at least some of said energizable means including said heat transfer means are maintained in an energized state whereby the apparatus is maintained ready to proceed to said image forming mode in response to an image forming signal; and a second standby mode which commences upon the termination of said first standby mode if, during said first standby mode, no image forming signal is produced, wherein during said second standby mode said rotatable member and said reciprocal member are stationary, and at least said heat transfer means is switched from an energized state to another state but, wherein at least a part of the apparatus remains energized;

wherein said control means comprises computer means including a memory which stores a program comprising instructions for the operation of said energizable means and the part of the apparatus remaining energized during the second standby mode comprises said computer.

12. An image forming apparatus comprising;

a rotatable member;

a plurality of energizable means for forming an image on said rotatable member and for transferring the image to a transfer material, said plurality of energizable means including imaging means and heat transfer means for affecting the temperature of a portion of the apparatus;

means for causing at least some imaging means to initiate an image forming operation; and control means for controlling the energization state of said energizable means to provide a plurality of energizational modes, including:

an image forming mode in which said member is moved and at least some of said energizable means activated to effect the formation of images;

a post-rotation mode wherein said member is rotated to effect cleaning thereof for a predetermined time interval following the termination of said image forming mode;

a first standby mode wherein said member is stationary and at least some of said energizable means including said heat transfer means are maintained in a state of activation, whereby the apparatus is maintained ready to proceed to said image forming mode in response to an image forming signal; and a second standby mode which commences upon the termination of said first standby mode if, during said first standby mode, no image forming signal occurs, wherein during said second standby mode said member is stationary and said heat transfer means switches from an energized state to a deenergized state but wherein at least a part of the apparatus remains activated.

13. Image forming control apparatus according to claim 12, further comprising means for controlling the time interval from the actuation time of said initiating means to the start of operation of said imaging means in accordance with the actuating time of said initiating means in the event that said initiating means is actuated after said rotatable member has stopped rotating.

14. Image forming control apparatus according to claim 13, wherein said control means sets said time interval in accordance with the length of the non-operation time of said initiating means.

15. Image forming control apparatus according to claim 13, wherein said control means sets a predetermined start preparation time interval in accordance with whether said initiating means is actuated during or after said first standby mode.

16. Image forming control apparatus according to claim 14 or 15, wherein said control means controls the amount of rotation of said rotatable member prior to the start of an image forming operation.

17. Image forming control apparatus according to claim 12, wherein said imaging means comprises at least one means selected from the group consisting of corona discharger means for providing corona discharging of said rotatable member, exposure means, and developing means for forming a visual image on said rotatable member.

18. Image forming control apparatus according to claim 12, wherein said heat transfer means includes at least one means selected from the group consisting of means for heating and exposure means for scanning an original, means for fixing the transferred image, and fan means for preventing temperature rise in the apparatus.

19. Image forming control apparatus according to claim 12, further comprising means for compensating the image formation, said compensating means operating at least after said heat transfer means has been de-energized during said second standby mode.

20. Image forming control apparatus according to claim 19, wherein said compensating means comprises at least one means selected from the group consisting of means for warming up said rotatable member, means for pre-heating a fuser for fusing the transferred image, means for pre-heating an exposure means for exposing an original, and means for pre-heating a developer for developing a latent image.

21. Image forming control apparatus according to claim 12, further comprising at least one means selected from the group consisting of means for cleaning said rotatable member during rotation thereof, means for providing a uniform exposure and means for providing a uniform discharging.

22. Image forming control apparatus according to claim 12, wherein the image formed on said rotatable member is formed with a liquid developer.

* * * * *